United States Patent [19]

Baril et al.

[11] 4,135,170

[45] Jan. 16, 1979

[54] JUNCTION BETWEEN TWO MICROWAVE TRANSMISSION LINES OF DIFFERENT FIELD STRUCTURES

[75] Inventors: Michel Baril; Jacques Legendre, both of Paris, France

[73] Assignee: Thomson-CSF, Paris, France

[21] Appl. No.: 792,042

[22] Filed: Apr. 28, 1977

[30] Foreign Application Priority Data

Apr. 30, 1976 [FR] France ..... 76 12998

[51] Int. Cl.[2] ..... H01P 5/10

[52] U.S. Cl. ..... 333/26; 333/35; 333/84 M

[58] Field of Search ..... 333/26, 33, 35, 84 R, 333/84 M

[56] References Cited

U.S. PATENT DOCUMENTS

| | | | |
|---|---|---|---|
| 3,678,395 | 7/1972 | Hunton et al. | 333/84 M X |
| 3,678,418 | 7/1972 | Woodward | 333/26 |
| 3,715,692 | 2/1973 | Reuss, Jr. | 333/84 M X |
| 3,784,933 | 1/1974 | Scherer et al. | 333/84 R X |
| 3,835,421 | 9/1974 | De Brecht et al. | 333/26 |
| 3,995,239 | 11/1976 | Head et al. | 333/84 M X |
| 4,005,375 | 1/1977 | Pringle et al. | 333/84 M X |

*Primary Examiner*—Paul L. Gensler
*Attorney, Agent, or Firm*—Karl F. Ross

[57] ABSTRACT

A microstrip line, formed by a conductor strip on one side of a dielectric substrate and by a ground-plane layer on the other side thereof, is electrically coupled to another microwave-transmission line, formed by a slot in the ground-plane layer paralleling the strip, with the aid of a supplemental conductor element establishing a virtual short-circuit at an off-axial location on a portion of the strip overlapping the slot. The supplemental conductor element may be a wire, traversing the substrate, or a lateral extension of the strip defining an open-circuited quarter-wavelength line with the ground-plane layer.

9 Claims, 6 Drawing Figures

JUNCTION BETWEEN TWO MICROWAVE TRANSMISSION LINES OF DIFFERENT FIELD STRUCTURES

FIELD AND BACKGROUND OF THE INVENTION

The present invention relates to an arrangement for coupling dissimilar lines used for microwave transmission, and more particularly to the realization of a coupling or transition between a slot line and a microstrip line.

Conventional transition-forming junctions involving slot lines coupled either to a microstrip line or to a coaxial line are described, for example, in an article entitled "Slot line characteristics" by Mariani, MTT, vol. 17, No. 12, December 1969. However, those transitions are produced between slot lines and microstrip or coaxial lines whose axes of propagation are perpendicular to each other. Furthermore, the transmission lines project by distances equal to a quarter wavelength beyond the intersection of their axes. The result is that the overall structures of these junctions are bulky and the transitions are selective and have a relatively narrow passband.

OBJECT AND SUMMARY OF THE INVENTION

The object of our invention is to provide means for minimizing or eliminating these drawbacks.

This object is realized, pursuant to our present invention, by the provision of an assembly for the propagation of microwaves comprising a first transmission line of symmetrical field structure and a second transmission line of asymmetrical field structure. A common dielectric substrate carries first conductor means forming a strip which is part of the first transmission line and second conductor means provided with a slot which parallels that strip and forms part of the second transmission line; in the embodiment particularly described hereinafter, the strip lies on one substrate surface and the second conductor means is a slotted ground-plane layer on another substrate surface parallel to the former, this layer being in fact common to both lines. A virtual short-circuit — at least for microwaves — is established between the two lines, along lateral edges of overlapping terminal portions thereof and thus at an off-axial location, by supplemental conductor means which may be a wire traversing the substrate or a lateral strip extension forming with the ground-plane layer an open-circuited ancillary line of a quarter-wavelength at the microwave frequency.

Pursuant to a more particular feature of our invention, the supplemental conductor means is a lateral extension of the strip defining an open-circuited ancillary line of a quarter-wavelength (at the frequency of the propagated microwaves) with the ground-plane layer.

BRIEF DESCRIPTION OF THE DRAWING

The above and other features of our invention will now be described in detail with reference to the accompanying drawing in which.

DETAILED DESCRIPTION

A junction according to our invention ensures full coupling between two kinds of line which can be produced as planar structures on substrates having high dielectric constants. More particularly, the coupling links a slot line having an asymmetrical field structure and a line having a symmetrical field structure, i.e. a microstrip line. The interest in such a transition, which is very simple, is enhanced by the facts that slot lines have many applications, more than other kinds of line, as they are usually employed in the field of filters, ferrites, couplers, and circuits containing semiconductor components, and that it is possible to associate them with series arrangements consisting of localized members, whereas parallel arrangements are needed in the case of the other types of lines.

From the point of view of its electrical behavior, the transition according to our invention needs to be capable of transmitting microwave energy under the most favorable conditions of voltage standing-wave ratio and insertion loss over a wide frequency band.

Before describing a transition which meets the above requirements, it may be useful to give some definitions.

Figure 1A:
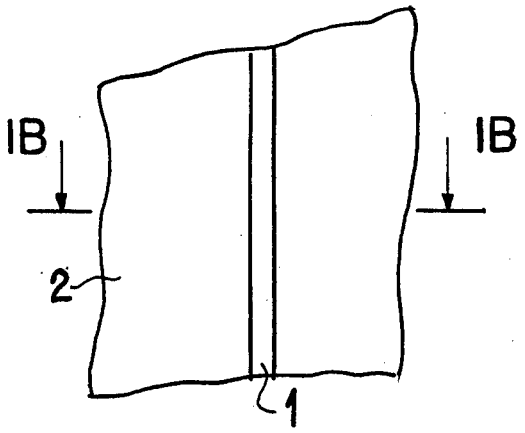
FIG. 1*a* is a top view of a slot line.
Figure 1B:
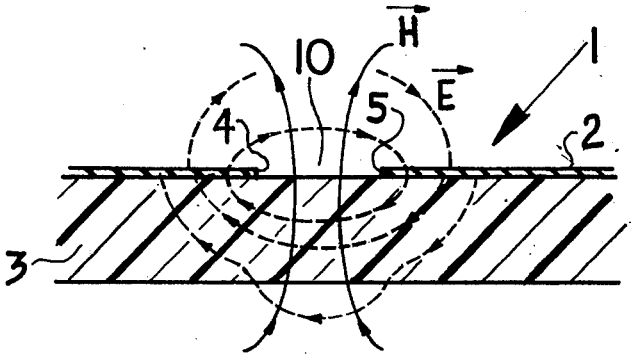
FIG. 1*b* is a sectional view taken on the line IB — IB of FIG. 1*a;*

FIGS. 1*a* and 1*b*, are plan and sectional views of a slot line 1 formed by an elongate gap 10 in a ground-plane layer 2 which is applied to a dielectric substrate 3. The dielectric support provides a mechanically solid base for metal conductors which are generally applied by known photo-etching or photolithographic production techniques. In a slot-type propagation line, virtually the entire energy is propagated in the dielectric 3 and is concentrated between the edges 4 and 5 of the slot or gap 10. The thickness of the dielectric substance depends on its nature, and the width of the slot line thus determines the characteristic impedance of the line. The dielectric substance may be polytetrafluorethylene, a beryllium oxide, an alumina ceramic, quartz, or a ferrite.

In FIG. 1*b* the lines of force of the electrical field $\vec{E}$ are shown dotted whereas those of the magnetic field $\vec{H}$ are solid.

Figure 2A:
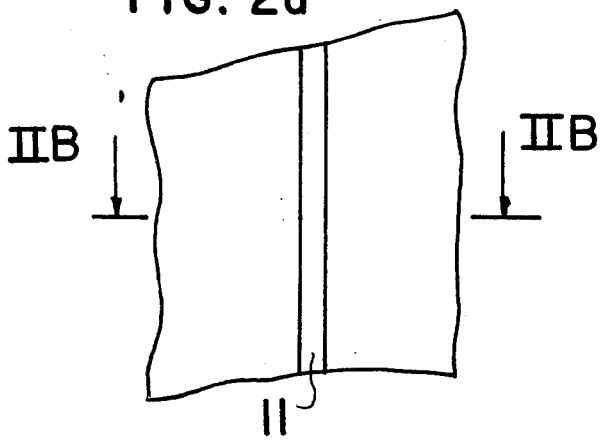
FIG. 2*a* is a top view of a microstrip line with a single ground plane.
Figure 2B:
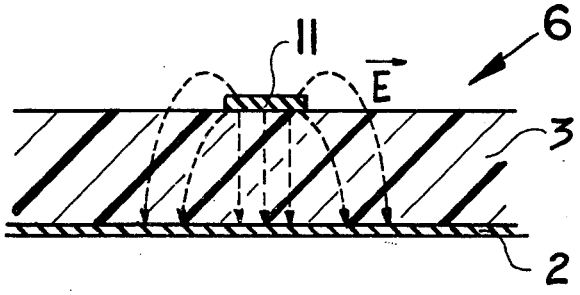
FIG. 2*b* is a sectional view taken on the line IIB — IIB of FIG. 2*a;*

FIGS. 2*a* and 2*b* are a plan view and a sectional view of a transmission line 6 of the microstrip type which consists of a dielectric plate 3 positioned between a strip 11 and a metal layer 2 constituting a ground plane. As in the case of the slot line 1, virtually the entire energy is concentrated in the dielectric. In FIG. 2*b* the lines of force of the electric field $\vec{E}$ are again shown dotted.

Figure 3:
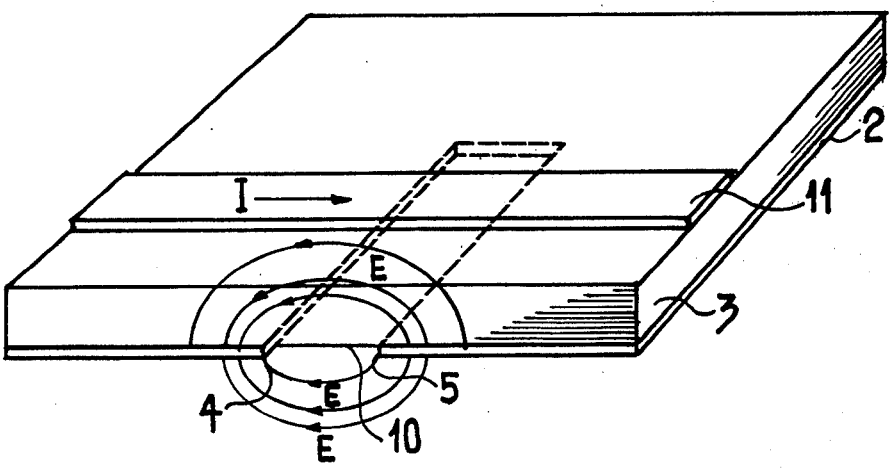
FIG. 3 PRIOR ART
FIG. 3 is a perspective view of a prior-art inter-line coupling.

In FIG. 3 we have shown how a coupling or junction is conventionally formed between a slot line 2, 10 and a microstrip line 2, 11 which are carried on the same substrate 3 and have mutually orthogonal axes of propagation. The conductive strip 11 carries an electrical current I flowing in a given direction at a given moment. At the same moment the ground plane 2 carries an electric current whose direction is opposite that in the strip. The slot 10, which is cut from the ground-plane layer 2 of the microstrip line and extends perpendicularly to its strip 11, interrupts the flow of the current traveling through the ground plane. The resulting potential difference sets up between the two edges 4 and 5 of the slot an electrical field $\vec{E}$ which is at a maximum underneath the conductive strip and zero at the short-circuited end of the slot.

The invention makes it possible to avoid this orthogonal relationship between the axes of propagation of the lines to be coupled, chiefly for the purpose of reducing the physical bulk of the assembly.

Thus, the microstrip and slot lines to be coupled to each other are formed on a substrate in such a common way that their axes of propagation are parallel.

In accordance with the invention, the coupling is effected in such a way that the lines of force are modified by a supplemental conductor element which virtually short-circuits the two parallel transmission lines - at least for high-frequency waves propagated therealong — at an off-axial location. Though the microstrip line 2, 11 has a single ground-plane layer, our invention is also applicable to an assembly in which the line of symmetrical field structure is of the coplanar type.

Figure 4:
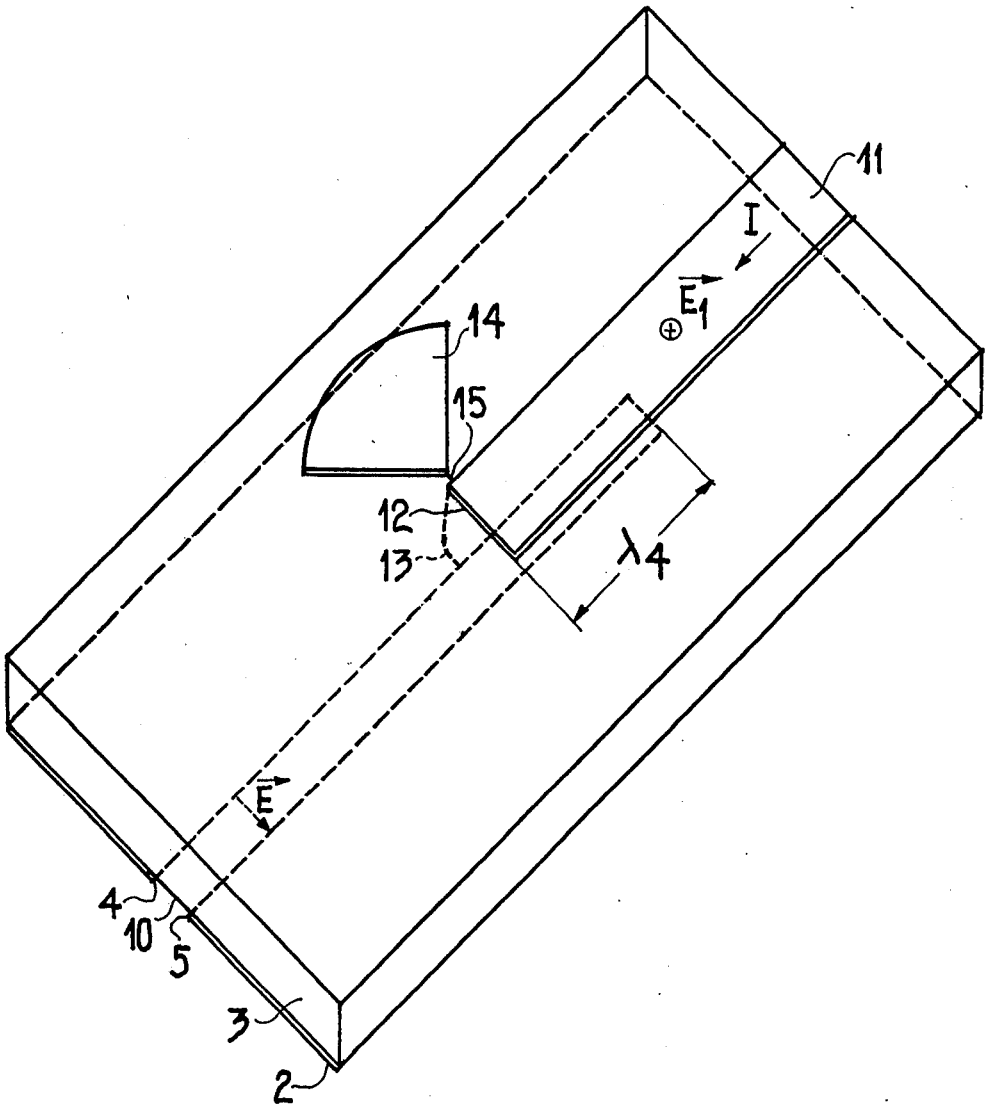
FIG. 4 is a perspective view of a junction between a slot line and a microstrip line in accordance with our invention.

More particularly, FIG. 4 shows a strip 11 on one side of substrate 3 whose other side carries the ground-plane layer 2 provided with a slot 10 paralleling the strip 11. The microstrip line 2, 11 can be fed with a wave whose electrical field $\vec{E}_1$ is perpendicular to the major substrate surfaces. This field $\vec{E}_1$ is unable to induce electrical currents in the slot line 10, wherein propagation can take place only with a field $\vec{E}$ perpendicular to the axis of propagation. The virtual short-circuit provided in accordance with our invention serves to bring one lateral edge of one of the lines to the same potential as a corresponding edge of the other line.

This equalization of potential may be performed directly by connecting the supplemental conductor element, such as a strand of wire, between the aforementioned edges of the two lines to be coupled. For this purpose we attach to an end of a transverse edge 12 of the strip 11 a wire 13 which passes through the substrate and is connected to the underlying edge 4 of the slot 10. In the transverse plane containing this wire there is set up an asymmetry in the electrical field $\vec{E}_1$ of the microstrip line which manifests itself as a potential difference across the slot edges, giving rise to an electrical field $\vec{E}$. Thus, the microstrip line 2, 11 and the slot line 2, 10 are effectively coupled to each other . In order that the coupling shall be at a maximum, the slot is extended by a distance of $\lambda/4$ under the strip so that the two lines overlap over a quarter wavelength. The width of the strip, the width of the slot and the thickness of the substrate are determined by the value of the characteristic impedance of the transmission line upstream and downstream of the resulting junction. The matching of this impedance is desirable in order to give the maximum transmitted power and to avoid standing waves.

The physical connection formed by wire 13 necessitates a piercing of the substrate at a corner of the strip portion overlapping the slot.

Another solution, which is likewise shown in FIG. 4, uses as the supplemental conductor element a quarter-wavelength lateral extension 14 of the strip 11 connected to an edge thereof by a short wire 15. The other end of element 14 is open-circuited and of arcuate shape. From the electrical point of view, the effect of providing this quarter-wavelength conductor element is to create a short-circuit for microwaves of the proper frequency between the strip 11 and its ground plane 2, more specifically between the aforementioned strip and slot edges. A traveling microwave can thus be propagated from the strip line 2, 11 to the slot line 2, 10 (or vice versa). The illustrated sectoral shape of element 14 affords a large area of confrontation with layer 2 while confining the short-circuit to a narrowly localized region at the vertex of the sector adjacent strip 11.

There has thus been described a way of coupling lines of symmetrical and asymmetrical field structure by junction-forming means of great simplicity usuable with advantage for receiving or transmitting circuits, in particular for those of low or medium power. The power limitation is due to the actual technological characteristics of the lines employed. As already mentioned, the electrical characteristics of the transitions according to the invention are beneficial in that they allow large bandwidths, low insertion losses and the possibility of adding series arrangements. What is more, the transitions are completely reliable.

Reference is made, as pertinent art, to IEEE Transactions on microwave theory and technique, April 1976, pages 231–233.

We claim:

1. In an assembly for the propagation of microwaves, in combination:

a dielectric substrate;

a first transmission line of symmetrical field structure comprising first conductor means forming a strip on said substrate;

a second transmission line of asymmetrical field structure comprising second conductor means on said substrate forming a slot paralleling said strip, said slot and said strip extending toward each other from opposite directions and having overlapping terminal portions; and supplemental conductor means on said substrate establishing a virtual short-circuit between said terminal portions, along lateral edges thereof, at least for microwaves propagated thereover.

2. The combination defined in claim 1 wherein said substrate has two parallel major surfaces, said strip being disposed on one of said surfaces, said second conductor means being a ground-plane layer disposed on the other of said surfaces and common to both said transmission lines.

3. The combination defined in claim 2 wherein said supplemental conductor means comprises a wire conductively interconnecting said lateral edges and traversing said substrate.

4. The combination defined in claim 2 wherein said supplemental conductor means comprises a lateral extension of said strip forming with said ground-plane lagyer an open-circuited ancillary line of a quarter-wavelength at the frequency of said microwaves.

5. The combination defined in claim 4 wherein said lateral extension comprises a sector-shaped conductor layer with a vertex adjacent said strip.

6. The combination defined in claim 1 wherein said terminal portions overlap for a quarter-wavelength at the frequency of said microwaves.

7. The combination defined in claim 1 wherein said supplemental conductor means is connected to a corner of said strip.

8. In an assembly for the propagation of microwaves, in combination:

a dielectric substrate having two parallel major surfaces;

a first transmission line of symmetrical field structure comprising first conductor means forming a strip on one of said surfaces;

a second transmission line of asymmetrical field structure comprising second conductor means forming a slot parallel to said strip on the other of said surfaces; and supplemental conductor means on said one of said surfaces extending laterally from said strip and forming with said second conductor means an open-circuited ancillary line of a quarter-wavelength at the frequency of microwaves propagated along said transmission lines, said ancillary line originating at a location in line with a lateral edge of said slot whereby a virtual short-circuit for said microwaves is formed at said location between said first and second transmission lines.

9. The combination defined in claim 8 wherein said supplemental conductor means comprises a sector-shaped layer with a vertex at said location.

* * * * *